US011220099B2

(12) United States Patent
Zaborowski

(10) Patent No.: US 11,220,099 B2
(45) Date of Patent: Jan. 11, 2022

(54) CONTAMINANT CONTROL PROCESS IN A RETRANSFER CARD PRINTER

(71) Applicant: ENTRUST CORPORATION, Shakopee, MN (US)

(72) Inventor: Alexander K. Zaborowski, Shakopee, MN (US)

(73) Assignee: ENTRUST CORPORATION, Shakopee, MN (US)

( * ) Notice: Subject to any disclaimer, the term of this patent is extended or adjusted under 35 U.S.C. 154(b) by 474 days.

(21) Appl. No.: 15/817,855

(22) Filed: Nov. 20, 2017

(65) Prior Publication Data

US 2018/0141327 A1 May 24, 2018

Related U.S. Application Data

(60) Provisional application No. 62/425,721, filed on Nov. 23, 2016.

(51) Int. Cl.

| | |
|---|---|
| ***B41F 16/00*** | (2006.01) |
| ***B41M 1/26*** | (2006.01) |
| *B41M 5/382* | (2006.01) |
| *B41M 5/025* | (2006.01) |

(52) U.S. Cl.

CPC ..... *B41F 16/0073* (2013.01); *B41F 16/0046* (2013.01); *B41M 1/26* (2013.01); *B41M 5/0256* (2013.01); *B41M 5/38221* (2013.01)

(58) Field of Classification Search

CPC ... B41F 16/0073; B41F 16/0046; B41M 1/26; B41M 5/0256; B41M 5/38221; B41M 5/345; B41M 2205/30

See application file for complete search history.

(56) References Cited

U.S. PATENT DOCUMENTS

| | | | | |
|---|---|---|---|---|
| 5,911,528 | A | 6/1999 | Song | |
| 6,554,044 | B2 | 4/2003 | Paulson et al. | |
| 8,654,164 | B2 * | 2/2014 | Mochizuki | B41J 2/0057 347/213 |
| 2003/0007060 | A1 | 1/2003 | Nakanura et al. | |

(Continued)

FOREIGN PATENT DOCUMENTS

| | | | |
|---|---|---|---|
| CN | 1163198 | A | 10/1997 |
| CN | 102574401 | A | 7/2012 |

(Continued)

OTHER PUBLICATIONS

International Search Report and Written Opinion issued in PCT/US2017/062523 dated Jan. 25, 2018, 13 pages.

(Continued)

*Primary Examiner* — David M. Gray
*Assistant Examiner* — Quang X Nguyen
(74) *Attorney, Agent, or Firm* — Hamre, Schumann, Mueller & Larson, P.C.

(57) ABSTRACT

A retransfer printing process that prevents dust and other contaminants from becoming statically or otherwise attached to the transfer layer of the retransfer film and/or to the print ribbon used to print on the retransfer film. In the described process, some or all of the unused retransfer film is rewound back onto the retransfer film supply and/or some or all of the unused print ribbon is rewound onto the print ribbon supply, for example until the next print job is submitted.

15 Claims, 6 Drawing Sheets

(56) References Cited

U.S. PATENT DOCUMENTS

| | | | |
|---|---|---|---|
| 2004/0207714 | A1 | 10/2004 | Takahashi et al. |
| 2007/0274755 | A1 | 11/2007 | Lien et al. |
| 2008/0216688 | A1 | 9/2008 | Hoffman et al. |
| 2009/0153599 | A1 | 6/2009 | Nubson et al. |
| 2012/0176460 | A1 | 7/2012 | Mochizuki et al. |
| 2016/0300128 | A1 | 10/2016 | Alvig et al. |

FOREIGN PATENT DOCUMENTS

| | | | | |
|---|---|---|---|---|
| CN | 102602169 | A | | 7/2012 |
| CN | 102686404 | A | | 9/2012 |
| CN | 103958206 | A | | 7/2014 |
| EP | 2347902 | A1 | | 7/2011 |
| JP | 2003252487 | A | | 9/2003 |
| JP | 2007090798 | A | * | 4/2007 |
| WO | 2012044282 | A1 | | 4/2012 |
| WO | 2016110746 | A1 | | 7/2016 |
| WO | 2016156818 | A1 | | 10/2016 |

OTHER PUBLICATIONS

Office Action; Chinese Patent Application No. 2017800817160, dated Jul. 24, 2020, With partial English translation (13 pages).
Extended European Search Report; European Patent Application No. 17873144.4, dated Jul. 27, 2020 (5 pages).

* cited by examiner

CONTAMINANT CONTROL PROCESS IN A RETRANSFER CARD PRINTER

FIELD

This disclosure relates to retransfer printing where an image is first printed onto a transfer layer of a retransfer film and the printed image is then transferred onto a surface of a substrate by adhering the transfer layer of the retransfer film to the surface and then stripping a portion of the retransfer film from the surface leaving behind the transfer layer containing the printed image on the surface.

BACKGROUND

Retransfer printing is a well-known technique for printing a high-quality image on a surface of a substrate including plastic card-shaped substrates. Examples of retransfer printing are described in U.S. Pat. Nos. 6,554,044 and 8,654,164.

SUMMARY

A retransfer printing process is described herein that prevents dust and other contaminants from becoming statically or otherwise attached to the transfer layer of the retransfer film and/or to the print ribbon used to print on the retransfer film. In one embodiment, the retransfer printing process can be performed in a document personalization machine such as a card printer.

In the described process, some or all of the unused retransfer film is rewound back onto the retransfer film supply and/or some or all of the unused print ribbon is rewound back onto the print ribbon supply, for example until the next print job is submitted. A portion of the unused retransfer film and/or unused print ribbon, or all of the unused retransfer film and/or unused print ribbon up to the location of the previously printed and applied image, can be rewound back onto the respective supply. By rewinding the unused retransfer film and/or the unused print ribbon back onto the respective supply, contaminants such as dust and other particles are prevented from becoming attached to the retransfer film and/or to the print ribbon, which as a result reduces or prevents contaminants from accumulating on the print head, and prevents contaminants from becoming embedded in the next printed image that is printed onto the substrate.

DRAWINGS

FIG. 4-C illustrate an example sequence of movements of the retransfer film and the print ribbon in the contaminant control process described herein.

DETAILED DESCRIPTION

The retransfer printing process described herein can be applied to retransfer printing on any substrate that may benefit from the contaminant control process described herein. However, for sake of convenience, the substrate will hereinafter be described as being a plastic card including, but not limited to, a financial (e.g., credit, debit, or the like) card, a driver's license, a national identification card, a business identification card, a gift card, and other plastic cards which bear personalized data unique to the cardholder and/or which bear other card information. In other embodiments, the substrate can be a page of a passport.

The retransfer printing process is performed by a retransfer printing system. In the case of a plastic card as the substrate, the retransfer printing system may also be referred to as a card personalization machine or card personalization system, or a retransfer card printer. The card personalization machine can be a desktop card personalization machine that is designed to personalize cards one at a time, for example on the order of tens or hundreds per hour, or a central issuance system that is designed to simultaneously personalize multiple cards, for example on the order of thousands per hour. A card personalization machine is intended to encompass a machine that personalizes cards as well as passports and other identification documents.

Figure 1:
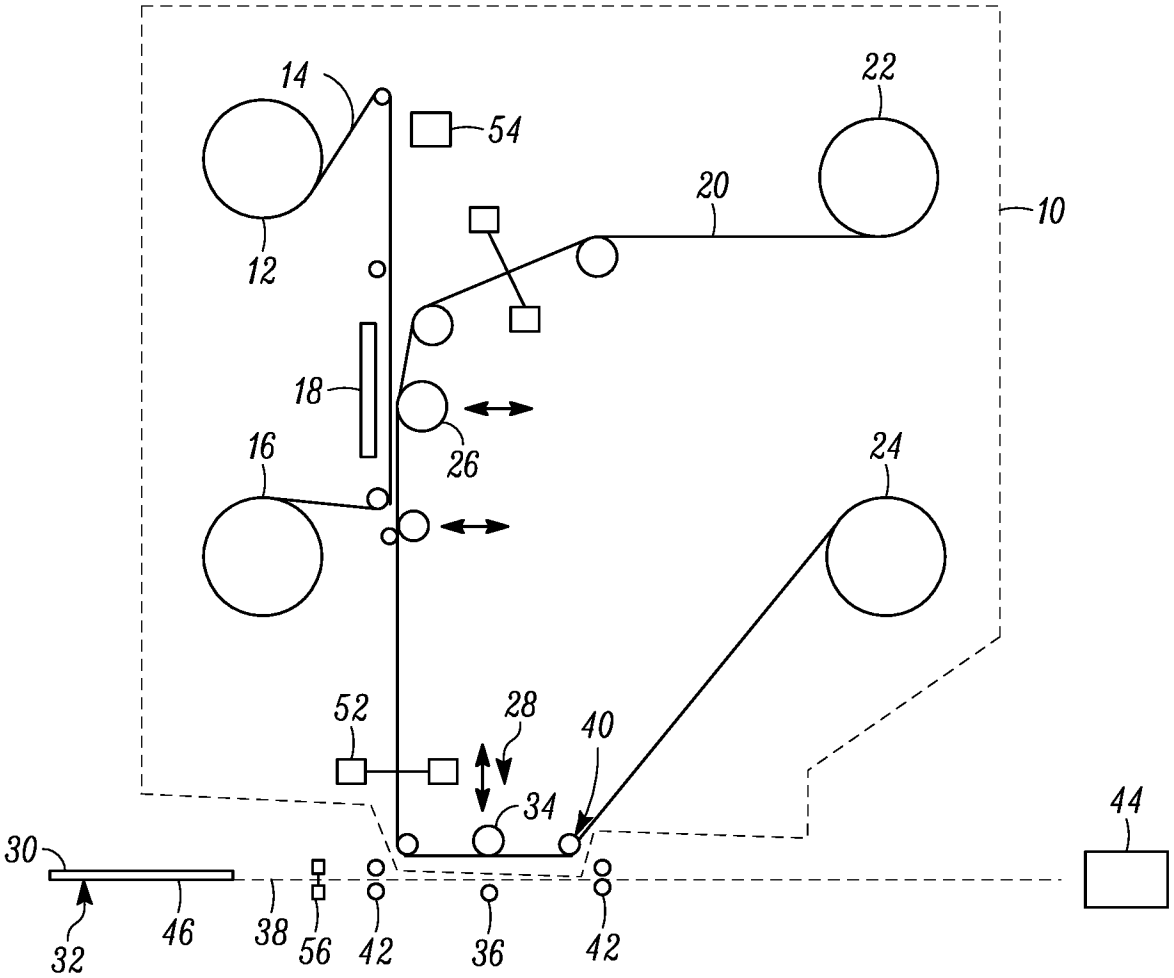
FIG. 1 illustrates a portion of a retransfer card printer that can implement the contaminant control process described herein.

FIG. 1 illustrates an example of a print engine 10 configured for retransfer printing. The print engine 10 is part of a card personalization machine, also referred to as a retransfer card printer. An example of a card personalization machine that can perform retransfer printing is described in U.S. Published Application No. 2016/0300128 filed on Apr. 8, 2016, which is incorporated herein by reference in its entirety. The specific construction and operation of retransfer card printers, including the print ribbon, the retransfer film, printing an image on the retransfer film, and transferring the printed image onto a surface of a card, is well known in the art.

The illustrated configuration of the print engine 10 in FIG. 1 includes a print side that includes a print ribbon supply 12 from which a supply of monochrome or multi-color print ribbon 14 is supplied, and a print ribbon take-up 16 that takes-up used print ribbon 14. The print ribbon 14 is directed past a print head 18, which in the illustrated example can be stationary, which transfers dye or pigment ink from the print ribbon 14 onto a retransfer film 20. After printing, the used print ribbon 14 is eventually wound onto the take-up 16.

The retransfer film 20 is supplied from a retransfer film supply 22 on a retransfer side, and after retransfer the remaining film is eventually wound onto a retransfer film take-up 24 also on the retransfer side. The retransfer film 20 is directed past a platen roller 26 positioned opposite the print head 18 and which in the illustrated example can be moved toward and away from the print head 18 to press the retransfer film 20 and the print ribbon 14 between the print head 18 and the platen roller 26 during printing onto the retransfer film 20.

With continued reference to FIG. 1, once a desired image is printed onto the retransfer film 20, the section of the retransfer film 20 with the printed image thereon is advanced to a transfer station 28 where the printed image on the retransfer film 20 is transferred onto a surface 30 of a card 32. In this example, the transfer station 28 includes a heated transfer mechanism 34, for example a transfer roller, that is movable toward and away from a fixed platen 36 positioned on the opposite side of a card travel or transport path 38 depicted by a dashed line. The heated transfer mechanism 34 presses the portion of the retransfer film 20 containing the printed image against the surface 30 of the card 32 which is backed by the platen 36, with the retransfer film 20 and the card 32 then being transported together past the heated transfer mechanism 34 to laminate the retransfer film 20 including the transfer layer containing the printed image onto the card surface 30. The retransfer film 20 and the card 32 are then transported to a stripping station 40 that includes a stripping pin or the like where a portion of the retransfer film 20 is stripped from the card surface 30 leaving behind the transfer layer containing the printed image on the card surface 30. Ultimately, the retransfer film 20, minus the transferred image, is wound onto the film take-up 24. The card 32 is transported along the card travel path 38 by a card transport mechanism, such as sets of rollers 42.

If printing on both sides of the card 32 is required, a card reorienting mechanism 44 (or card flipper 44) can be located downstream of the stripping station 40 in the card travel path 38. The card reorienting mechanism 44 can receive the card 32, for example after the printed image has been applied to the surface 30, and flip the card 32 over (i.e. flip the card 180 degrees) so that the opposite surface 46 is now facing upward. The card 32 can then be transported back upstream of the transfer station 28 in order to retransfer print a printed image from the retransfer film 20 onto the surface 46. In embodiments where printing on the surface 46 is not required, the card reorienting mechanism 44 is not required, or the card 32 can be transported through the card reorienting mechanism 44 without flipping the card 32.

Still referring to FIG. 1, various sensors can be provided for sensing movements of the retransfer film 20, the print ribbon 14, and the card 32. For example, a sensor 50 can be provided for sensing one or more index marks (described further below) on the retransfer film 20. Another sensor 52, located just upstream of the transfer station 28, can also be provided for sensing the one or more index marks (described further below) on the retransfer film 20. In addition, a sensor 54 can be provided for sensing one or more index marks (described further below) on the print ribbon 14. In addition, a sensor 56 can be provided along the card travel path 38 upstream of the transfer station 28 for sensing the card 32. The sensors 50, 54 are used for sensing the retransfer film 20 and the print ribbon 14, respectively, to register the retransfer film 20 and the print ribbon 14 prior to beginning the print operation on the retransfer film 20. The sensor 52 and the sensor 56 are used for sensing the retransfer film 20 and the card 32, respectively, to register the printed image printed onto the retransfer film 20 with the card surface. The use of index marks on a retransfer film and a print ribbon, and sensors to sense the index marks and sense the card, in order to register the retransfer film and the print ribbon, and to register the printed image printed onto the retransfer film with the card surface, is well known in the art.

Figure 2:
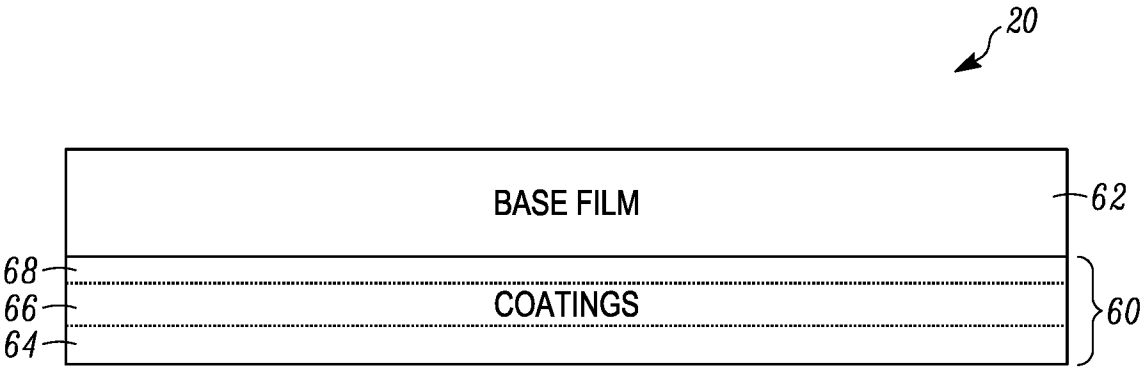
FIG. 2 is a cross-sectional view through the retransfer film showing example components thereof.

Referring to FIG. 2, an example construction of the retransfer film 20 is illustrated in cross-section. The retransfer film 20 generally includes various coatings 60 and a base film 62 supporting the coatings. The coatings 60 can include, but are not limited to, an image receiving layer 64 that is receptive to receiving the dye or pigment ink from the print ribbon 14 and in or on which the printed image is formed, a barrier layer 66, and a peeling layer 68 that helps the image receiving layer 64 and the barrier layer 66 separate from the peeling layer 68 and the base film 62 during stripping. The image receiving layer 64, by itself or in combination with any other layer that is transferred with the image receiving layer 64, such as the barrier layer 66, may also be referred to as a transfer layer since the layer 64 is the layer of the retransfer film 20 that contains the printed image and is transferred onto the card 32. The base film 62 can be any material suitable for carrying the coatings 60. For example, the base film 62 can be formed from polyethylene terephthalate (PET). The retransfer film 20 can include other layers that are not explicitly illustrated, such as, but not limited to, a primer layer on the image receiving layer 64 to facilitate adhesion of the image receiving layer 64 to the card surface, and other layers.

During stripping at the stripping station 40 to transfer the printed image onto the card surface, a portion of the retransfer film 20 is stripped from the surface of the card 32 leaving behind the image receiving layer 64 that contains the printed image. In particular, the base film 62 and the peeling layer 68 are stripped from the barrier layer 66 (if used) and the image receiving layer 64 and ultimately wound onto the film take-up 24 (visible in FIG. 1). The barrier layer 66 (if used) and the image receiving layer 64 (containing the printed image) are left behind on the card surface.

Figure 3:
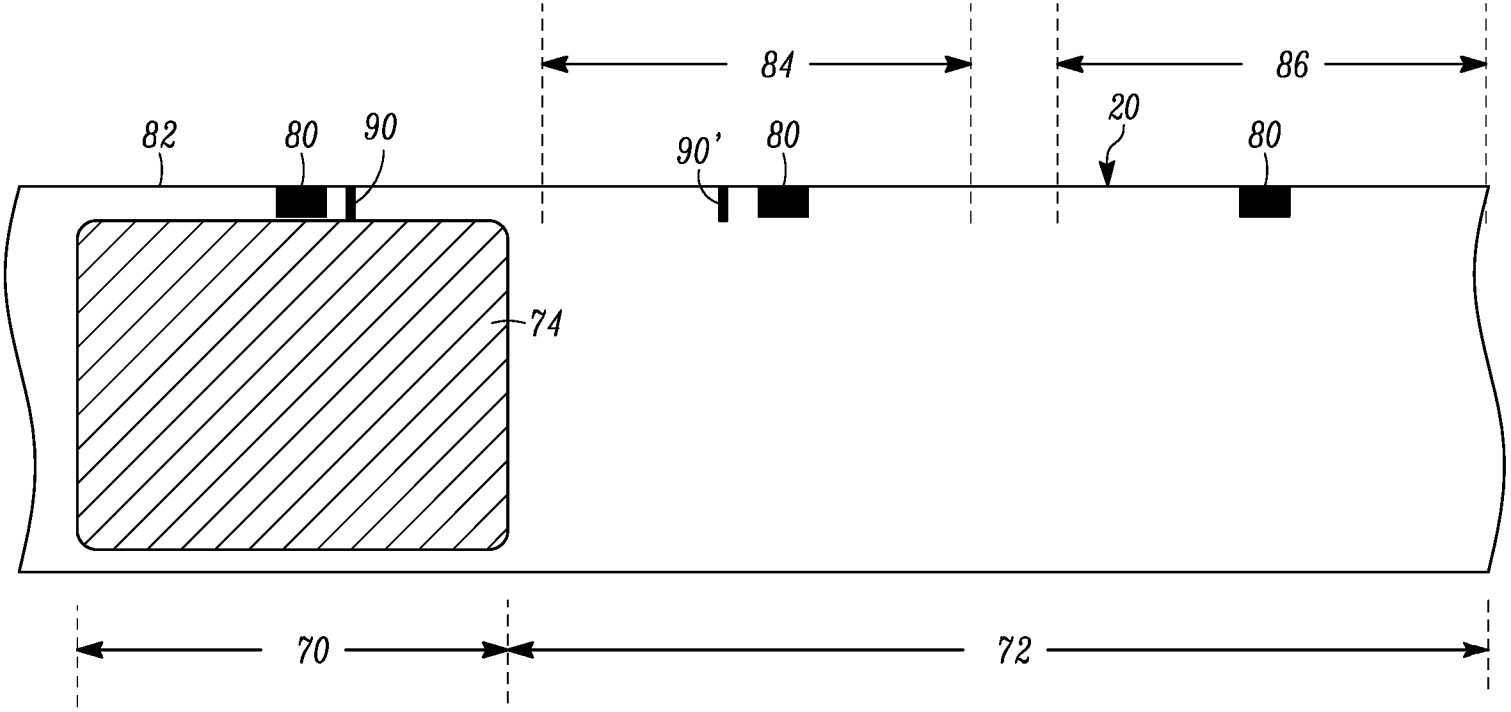
FIG. 3 is a top plan view of a section of the retransfer film showing the location of a previously transferred printed image as well as index marks.

FIG. 3 is a top plan view of a section of the retransfer film 20. The illustrated section of the retransfer film 20 includes a used portion 70 and an unused portion 72 located downstream of the used portion 70. The used portion 70 defines a section 74 where a previously printed image was printed on the image receiving layer 64 (see FIG. 2) in the shape of the card surface, and the image receiving layer 64 with the printed image was subsequently transferred from the retransfer film 20 onto the card surface to apply the image to the card surface. So the section 74 in FIG. 3 includes the base film 62, the peeling layer 68 and any other layers that do not transfer onto the card surface during transfer of the printed image. The retransfer film 20 outside of the section 74, including in the unused portion 72, includes the base film 62 and all of the various coatings 60 discussed above in FIG. 2. The next image to be printed will be printed on the unused portion 72.

FIG. 3 also illustrates a number of index marks 80 that are pre-printed or otherwise pre-formed on the retransfer film 20. The index marks 80 are sensed by the sensor 50 for use in registering the retransfer film 20 and the print ribbon 14, as well as being sensed by the sensor 52 to register the printed image printed onto the retransfer film 20 with the card surface. The index marks 80 can be any markings (or absence of markings such as notches or holes) that can be sensed to achieve registration as described herein. In the illustrated example, there is one index mark 80 for each intended printed image. As implied in FIG. 3 by the section 74 (which indicates where an image was previously printed on the retransfer film 20 and subsequently transferred to the card surface), the index marks 80 are located on the retransfer film 20 relative to one another so that when an image is printed on the retransfer film 20, the index mark 80 is positioned relative to its corresponding printed image approximately halfway along the longitudinal length of the printed image, and between the printed image and an edge 82 of the retransfer film 20. However, the index marks 80 can have other locations on the retransfer film 20 relative to their corresponding printed images as long as the registration functions described herein can be achieved.

FIG. 3 also indicates a section 84 of the unused portion 72 of the retransfer film 20 where the next image will be printed, as well as a section 86 of the unused portion 72 of the retransfer film 20 where a second, subsequent image will be printed. For sake of convenience, it will be assumed that all of the printed images would have a rectangular, card-shaped outline like the section 74 to match the rectangular, card-shaped surface of the card 32, although not all of the printed images need have such an outline.

Figure 4A:
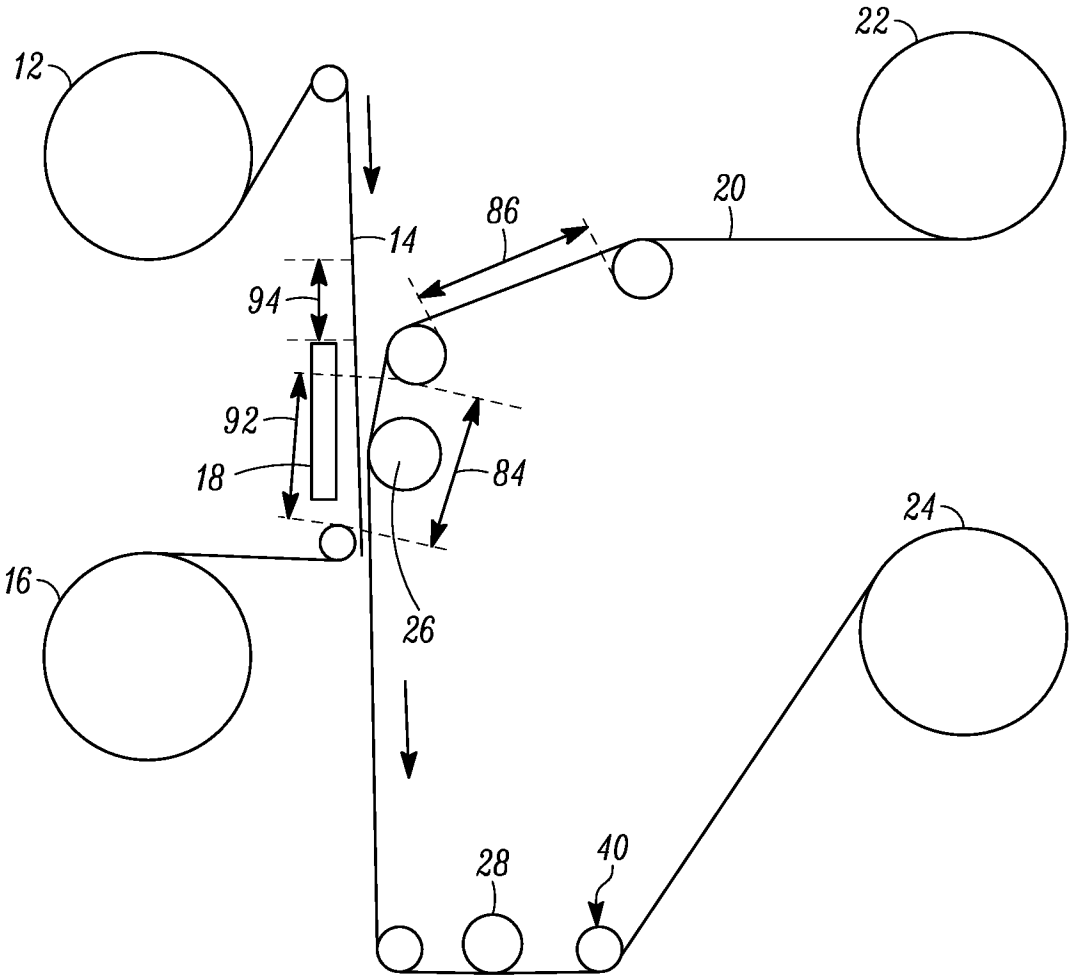

Referring now to FIG. 4-C, a sequence of movements of the retransfer film 20 in the contaminant control process described herein will now be described. The process begins with a print command being received using known techniques to perform a print job on the card 32. As a result, the retransfer film 20 and the print ribbon 14 are registered with each other by the print engine 10 using known techniques, and the ribbon 14 and film 20 are both advanced between the print head 18 and the platen roller 26 to begin printing the desired image onto the section 84 of the retransfer film 20 in known manner. FIG. 4A illustrates the section 84 of the retransfer film 20 located approximately half-way through the print station. In the case of monochromatic printing, the desired image can be printed onto the section 84 of the retransfer film 20 in a single pass past the print head 18. In the case of multi-color printing using a multi-color print ribbon 14, the retransfer film 20 and the print ribbon 14 may be reversed in direction after a first printing pass in order to perform a second, third, etc. additional printing passes to print additional colors on the image.

Figure 4B:
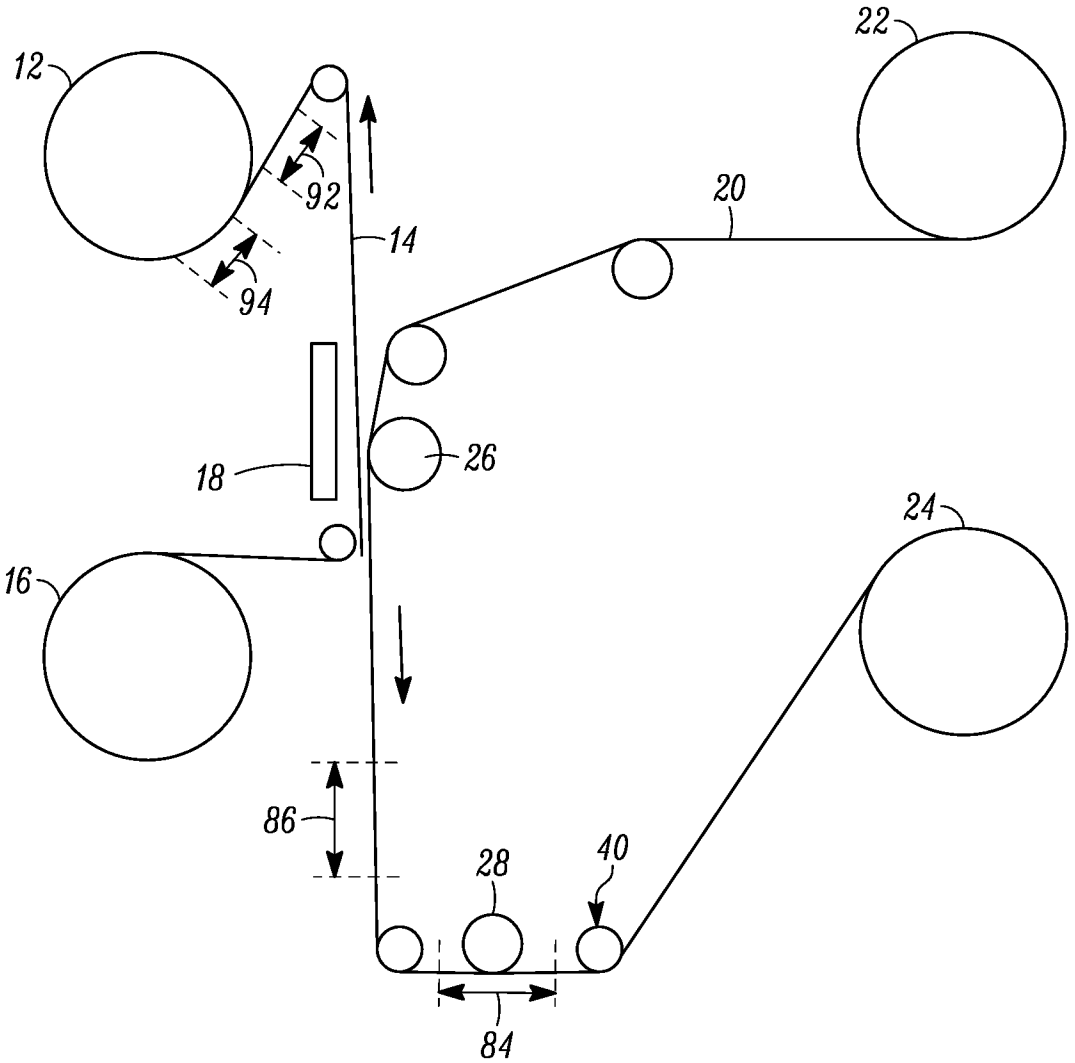

Once the image is completely printed in the section 84, the retransfer film 20 is advanced in the forward direction in the direction of the arrow so that the section 84 bearing the printed image is advanced to the transfer station 28 as shown in FIG. 4B. In the transfer station 28, the section 84 of the retransfer film 20 bearing the printed image is laminated to the card surface, and then the card 32 and the retransfer film 20 are advanced together to the stripping station 40 where the base film 20 and the peeling layer 68 are stripped from the card surface, leaving behind the image receiving layer 64 from the section 84 of the retransfer film 20 on the card surface.

Figure 4C:
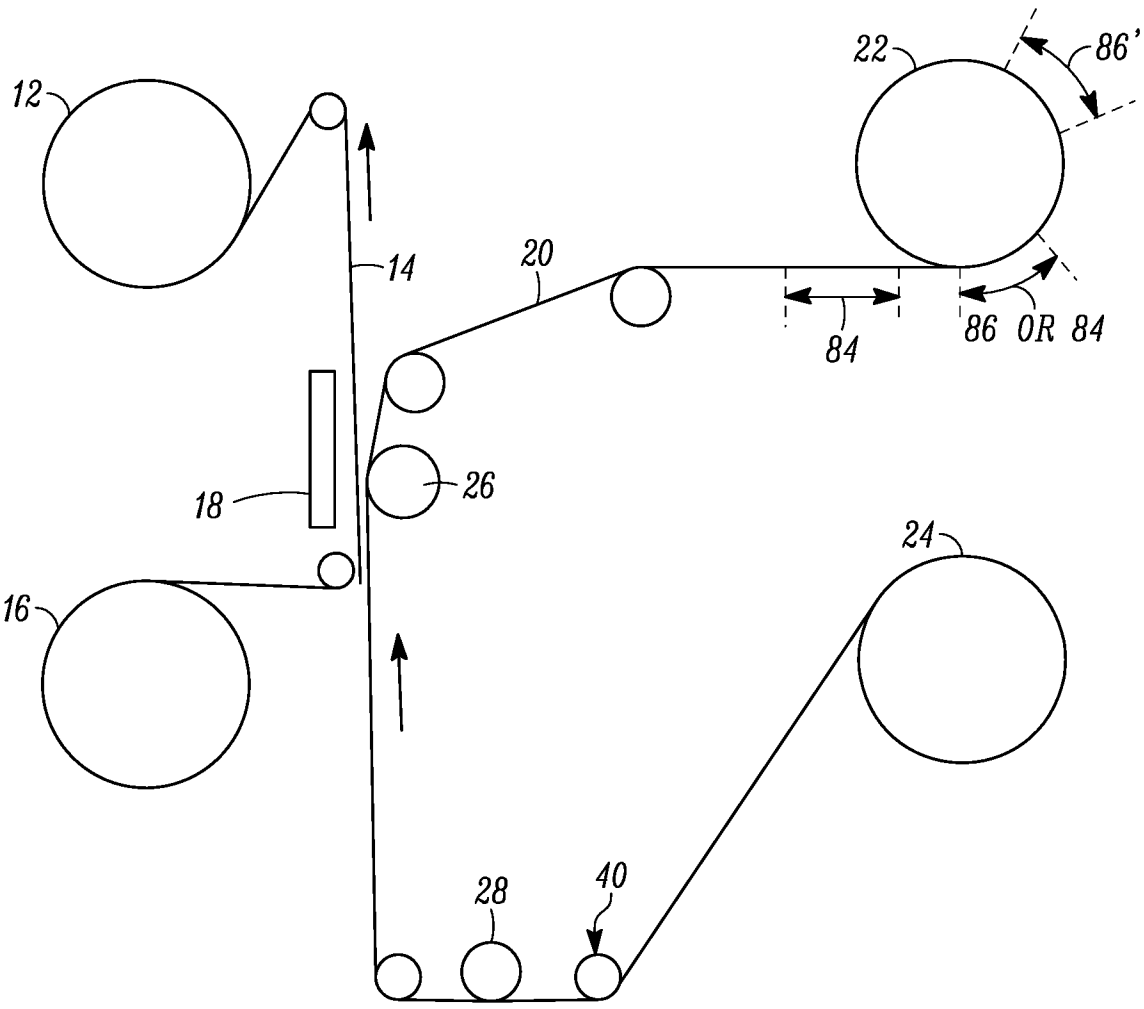

After stripping is complete and the printed image from the section 84 has been transferred to the card surface, the retransfer film 20 is reversed in direction in order to rewind some or all of the remaining unused portion 72 of the retransfer film 20 back onto the retransfer film supply 22. For example, FIG. 4C shows a point in time after the stripping process where the retransfer film 20 has been rewound in the direction of the arrow onto the supply 22 to an extent such that the unused section 86 is wound back onto the supply and the now used section 84 that contained the just transferred printed image is located adjacent to the supply 22. FIG. 4C also shows an alternative scenario where both the unused section 86' and the now used section 84 that contained the just transferred printed image are both wound back onto the supply 22. By rewinding the unused section 86 and other unused portions 72 of the retransfer film 20 back onto the supply 22, contaminants such as dust and the like are not able to adhere to and accumulate on the unused portions 72 of the retransfer film 20 while the system waits for the next print command. Rewinding the unused section 86 and other unused portions 72 of the retransfer film 20 back onto the supply 22 is not required in all instances. For example, after the printed image from the section 84 is transferred to the card surface, if another print command has already been received, then the rewinding of the unused section 86 and other unused portions 72 of the retransfer film 20 back onto the supply 22 need not be performed and the system can instead proceed immediately to printing the next image onto the retransfer film 20.

Returning to FIG. 3, to aid the system in determining where a used portion of the retransfer film 20, such as the used portion 70, containing a previously printed but transferred image is located, an index mark 90 can be printed in real-time on the retransfer film 20, for example on the image receiving layer 64, to indicate the location of the used portion 70. The index mark 90 is printed by the print head 18 at the print station. In one embodiment, the index mark 90 is printed in real-time on the retransfer film 20 at the same time the image is printed on the retransfer film 20. However, the index mark 90 can be printed at any time within the print engine 10 to indicate the location of the used portion. In the illustrated example, the index mark 90 is shown as being printed adjacent to the index mark 80 of the used portion 70, for example downstream of the index mark 80, and between the edge 82 of the retransfer film 20 and the previously printed image. However, the index mark 90 can be printed at other locations on the retransfer film 20 as well. In other embodiments, rather than determining where a used portion of the retransfer film 20 is located, an index mark 90' can be printed in real-time at a location on the retransfer film 20 to indicate the location of the next unused portion, such as the unused section 84 in FIG. 3, of the retransfer film 20 to be printed on. In other words, the index mark can indicate the next unused section rather than indicate the used section.

As indicated above, some or all unused portions of the print ribbon 14 can also be rewound back onto the supply 12 to prevent contaminants such as dust and the like from adhering to and accumulating on unused portions of the print ribbon 14 while the system waits for the next print command. The rewinding of the print ribbon 14 can be separate from or in addition to the rewinding of the retransfer film 20 onto the supply 22. Referring to FIG. 4A, a section 92 of the print ribbon 14 is shown being used to print on the section 84 of the retransfer film 20. An unused section 94 of the print ribbon 14 follows the section 92. After printing on the section 84, the print ribbon 14 can be reversed in direction and be rewound back onto the supply 12. For example, FIG. 4B shows a point in time after printing of the image is completed where the print ribbon 14 has been rewound onto the supply 12 in the direction of the arrow to an extent such that the unused section 94 is wound back onto the supply 12 and the used section 92 of the print ribbon 14 is located adjacent to the supply 12. Contaminants are thereby prevented from adhering to and accumulating on the unused section 94. Rewinding the unused section 94 and other unused portions of the print ribbon 14 back onto the supply 12 is not required in all instances. For example, after the image is printed, if another print command has already been received, then the rewinding of the unused section 94 and other unused portions of the print ribbon 14 back onto the supply 12 need not be performed and the system can instead proceed to printing the next image onto the retransfer film 20 once the previously printed image has been transferred to the card 32.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A contaminant control process in a retransfer card printer having a print ribbon provided from a print ribbon supply and a retransfer film provided from a retransfer film supply, the contaminant control process comprising:

printing an image onto the retransfer film using the print ribbon thereby generating a used section of the print ribbon;

thereafter transferring the printed image from the retransfer film onto a surface of a card thereby generating a used section of the retransfer film; and rewinding the retransfer film onto the retransfer film supply up to at least the location of the used section of the retransfer film.

2. The contaminant control process of claim 1, further comprising rewinding the print ribbon on the print ribbon supply up to at least the location of the used section of the print ribbon.

3. The contaminant control process of claim 1, further comprising printing an index mark onto the retransfer film separate from the printed image.

4. The contaminant control process of claim 3, comprising printing the index mark adjacent to another index mark on the retransfer film.

5. The contaminant control process of claim 3, comprising printing the index mark onto the retransfer film the same time the image is printed onto the retransfer film.

6. The contaminant control process of claim 3, comprising printing the index mark onto the retransfer film between an edge of the retransfer film and the image.

7. The contaminant control process of claim 3, comprising printing the index mark on a transfer layer of the retransfer film.

8. A contaminant control process in a retransfer card printer having a print ribbon and a retransfer film, the contaminant control process comprising:

using the print ribbon to print an image onto a transfer layer of the retransfer film in a print station;

thereafter advancing the retransfer film in a first direction to a transfer station and transferring a portion of the transfer layer containing the printed image from the retransfer film onto a surface of a card at the transfer station; and after the portion of the transfer layer containing the printed image has been transferred onto the surface of the card, reversing the retransfer film in a second direction opposite the first direction and rewinding all unused portions of the retransfer film onto a retransfer film supply.

9. The contaminant control process of claim 8, further comprising rewinding an unused portion of the print ribbon onto a print ribbon supply after printing the image.

10. The contaminant control process of claim 9, comprising rewinding all unused portions of the print ribbon onto the print ribbon supply.

11. The contaminant control process of claim 8, further comprising printing an index mark on the retransfer film in the print station separate from the printed image.

12. The contaminant control process of claim 11, comprising printing the index mark adjacent to another index mark on the retransfer film.

13. The contaminant control process of claim 11, comprising printing the index mark on the retransfer film the same time the image is printed on the retransfer film.

14. The contaminant control process of claim 11, comprising printing the index mark on the retransfer film between an edge of the retransfer film and the image.

15. The contaminant control process of claim 11, comprising printing the index mark on the transfer layer of the retransfer film.

* * * * *